United States Patent [19]

Williams

[11] 4,255,884

[45] Mar. 17, 1981

[54] APPARATUS FOR UNATTENDED CONVERSION OF A FRONT END LOADER

[76] Inventor: Earl D. Williams, P.O. Box 1565, Gillette, Wyo. 82716

[21] Appl. No.: 97,637

[22] Filed: Nov. 27, 1979

[51] Int. Cl.[3] ..... E01H 5/00

[52] U.S. Cl. ..... 37/117.5; 37/DIG. 3; 37/46

[58] Field of Search ..... 37/117.5, 118, 103, 37/50, 41 R, 42, 44, 46, DIG. 3; 414/723, 912; 172/438, 272, 274, 398, 801, 802, 804, 809

[56] References Cited

U.S. PATENT DOCUMENTS

| | | | |
|---|---|---|---|
| 2,014,783 | 9/1935 | Schubert | 37/46 X |
| 2,488,695 | 11/1949 | Upton | 37/DIG. 3 X |
| 2,529,208 | 11/1950 | Anderson | 37/117.5 |
| 2,718,719 | 9/1955 | Anderson | 172/801 X |
| 2,986,826 | 6/1961 | Timmons | 172/438 X |
| 3,528,685 | 9/1970 | Eastman | 172/272 X |
| 3,665,622 | 5/1972 | Lamb | 37/117.5 |
| 3,738,030 | 6/1973 | Olinger | 37/117.5 |
| 3,866,342 | 2/1975 | Cooper | 37/117.5 |
| 4,127,951 | 12/1978 | Hatch | 37/44 |
| 4,136,792 | 1/1979 | Wilson | 37/117.5 X |

FOREIGN PATENT DOCUMENTS

| | | | |
|---|---|---|---|
| 1414185 | 11/1975 | United Kingdom | 37/117.5 |

*Primary Examiner*—E. H. Eickholt
*Attorney, Agent, or Firm*—David H. Hill

[57] ABSTRACT

An auxiliary blade, such as a snowplow or the like, is quickly attached to or released from the bucket of a front end loader solely by pivotal movement of the bucket relative to the blade, without requiring the driver of the front end loader to dismount and operate any securing means.

7 Claims, 2 Drawing Figures

APPARATUS FOR UNATTENDED CONVERSION OF A FRONT END LOADER

FIELD OF THE INVENTION

This invention pertains generally to front end loaders and the like, and more particularly to means for quickly converting a front end loader to and from a snowplow or other dissimilar machine.

DESCRIPTION OF THE PRIOR ART

The prior art is replete with attachments, accessories and conversion units for front end loaders, whereby a single vehicle may serve more than one function, and Applicant is aware of several U.S. Pat. Nos. on the subject, viz., 2,986,826 Timmons, 3,440,744 Smith, 2,935,802 Wolfe, 3,034,237 Wolfe, 3,665,622 Lamb and 3,599,355 Lockwood. However, in the devices of these patents, as well as all other prior art of which applicant is aware, there is no showing of an apparatus or method by means of which a snowplow or other auxiliary blade may be quickly and easily mounted on or removed from the bucket of a front end loader, without requiring the vehicle operator to dismount and manually effect the connection or disconnection, whereby the vehicle may readily and interchangeably be utilized as a front end loader or a snowplow. Such ready interchangeability is of particular importance in the use of a such a vehicle for snow removal, since the operator may, while plowing snow, reach an exceptionally thick bank or drift of snow against which the plow alone may prove ineffective, and yet against which the bucket of the front end loader could easily work. In the equipment of each of the aforementioned prior art patents, to the extent that a conversion from bucket to plow and back to bucket is contemplated, the operator must climb down from his seat on the vehicle, operate various types of connecting or securing means and attach or remove various equipment parts in order to alternately provide the vehicle with a front bucket or a plow.

Applicant is aware of prior-art attempts to provide some sort of quick-release or quick-attach auxiliary equipment for front end loader buckets, and U.S. Pat. Nos. 3,587,887 DeCarli and 3,305,952 Dressler are illustrative of such prior art. However, the operator is still required in these equipments to dismount and effect the connection or disconnection.

SUMMARY OF THE INVENTION

In accordance with the present invention, as exemplified by a preferred embodiment described herein, the impractical, and, indeed, at times, impracticable nature of the prior-art devices is avoided by means of an auxiliary blade in the form of a free-standing or self-supporting V-shaped snowplow having upper portions which are adapted to be grasped by cooperating means affixed to the upper edge of the bucket of the front end loader as the bucket, once brought adjacent the free-standing plow, is pivoted upwardly and forwardly by the operator while seated on the vehicle at the usual controls therefor. Means are provided adjacent the bottom of the plow for receiving and holding the bottom edge of the loader bucket as the latter is pivoted upwardly and forwardly to effect the connection. Downward and rearward pivoting of the bucket disengages the bucket from the plow, leaving the latter standing in position to easily and quickly be reconnected to the bucket when needed, all without immediate attendance of an operator on the ground.

DESCRIPTION OF THE PREFERRED EMBODIMENT

Figure 1:
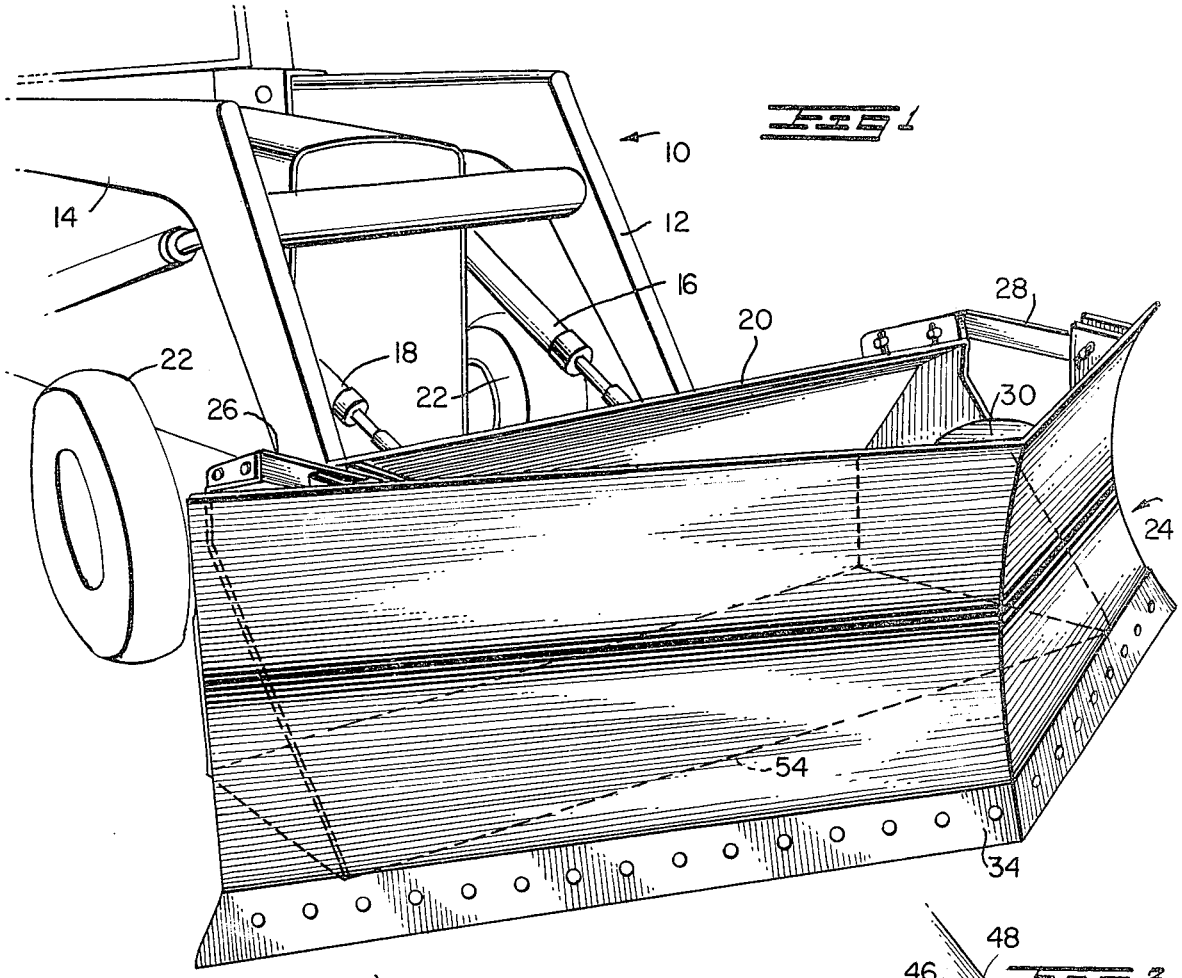
FIG. 1 is a perspective view of the forward portion of a front end loader with the auxiliary snow blade of the present invention mounted on the bucket thereof.

With reference now to the appended drawings in detail, FIG. 1 shows a front end loader indicated generally at 10, having the usual bucket-support arms 12 and 14 as well as the usual hydraulic control means 16 and 18, all of these elements being old and well known. The usual bucket 20 is shown mounted at the forward end of the preceding elements, and two of the vehicle tires 22 may also be seen in FIG. 1.

Figure 2:
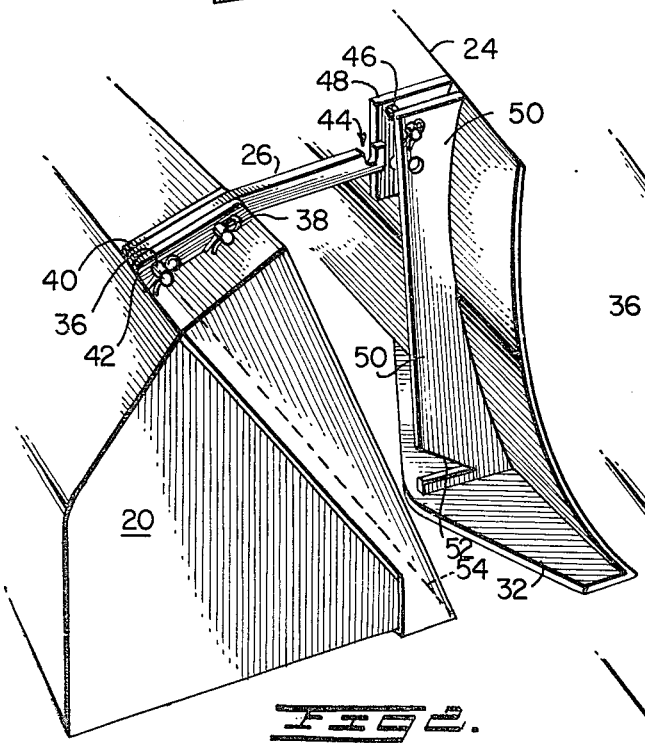
FIG. 2 is a perspective view of portions of the loader bucket and the plow blade, showing a preferred form of the interconnecting means.

In accordance with the present invention, an auxiliary blade or snow plow indicated generally at 24 is shown mounted on the forward face of bucket 20, supported in part by a pair of arms 26 and 28, more clearly understood in connection with the description of FIG. 2.

Snow plow or auxiliary blade 24 is of a conventional V-shape, being supported or reinforced by appropriate gussets 30 and 32 (FIGS. 2 and 3), along with other appropriate structural elements not shown but common in the art. As is common, a suitable wear plate or working edge 34 is attached to the lower portion of the forward face of the blade 24.

As may be seen more clearly in FIG. 2, the arm 26 is attached to and rendered integral with the upper forward edge of the loader bucket 20 by means of a pair of pins 36 and 38 passing through respectively aligned apertures in upright flanges 40 and 42 welded or otherwise secured to the upper edge of the bucket, the pins 36 and 38 passing through appropriate apertures in the end of arm 26 nearer the bucket 20. The opposite end of arm 26 is provided with an upwardly-open hook 44 which is adapted to cooperate with the pin 46 fixedly attached to the upper portion of the adjacent rear face of the auxiliary blade 24 by means of brackets or flanges 48 and 50 welded or otherwise suitably secured to the rear face of blade 24. Bracket 50 includes at its lower end a rearwardly-facing slot 52 adapted to receive the bottom edge 54 of bucket 20.

In the operation of the equipment illustrated in FIGS. 1 and 2, it will be understood that the auxiliary blade or snowplow 24 is free-standing or self-supporting on the ground, so that it remains in an upright or operative orientation without external support. In order to mount the blade 24 on the forward face of the bucket 20, the operator maneuvers the vehicle to a position in which the bucket 20 is closely adjacent the rear edge of the auxiliary blade 24, making certain that the hook 44 of the arm 26 is positioned just below the pin 46 of the plow blade 24. The operator then, without leaving his seat on the vehicle, operates the usual controls for tilting the bucket 20 slightly upwardly and forwardly, resulting in the hook 44 grasping the pin 46 and, as well, the bottom edge 54 of the bucket 20 entering the slot 52 and being held therein. By this simple and remote operation, the auxiliary blade is mounted on the front end loader bucket and is ready for use as a snowplow. As will be obvious to those skilled in the art, a simple reversal of the aforementioned pivotal movement, that is, a downward and rearward pivotal movement of the bucket 20 will disengage the hook 44 from the pin 46 and remove the bottom edge 54 of the bucket 20 from the slot 52, and the auxiliary blade 24 is once again free-standing or self-supporting on the ground, available for quick reconnection to the front end loader as desired.

Figure 3:
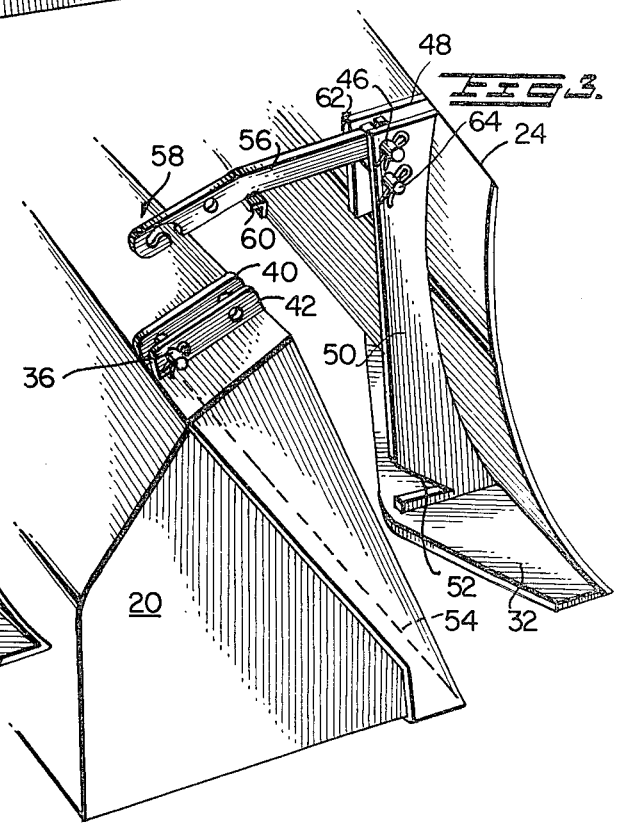
FIG. 3 is a perspective view similar to FIG. 2, showing an alternate form of interconnecting means.

FIG. 3 shows an alternative form of interconnection between the bucket 20 and the auxiliary blade 24, including an interconnecting arm 56 having a downwardly-open hook 58 adapted to engage the pin 36 extending between plates 40 and 42 on the top edge of the bucket 20. In this alternative connection, the pin 38 is omitted, but a bracket or stop 60 is employed at the underedge of the arm 56, adapted to abut the edge of the top of the bucket 20 when the hook 58 is in place around pin 36. In the embodiment shown in FIG. 3, the end of arm 56 remote from hook 58 is made fast to the upper portion of the auxiliary blade 24, preferably by providing the end of the arm 56 with an upwardly-open hook portion 62 adapted to engage pin 46 on the blade 24; a second pin 64 is placed between cooperating apertures in brackets 48 and 50 to retain the arm 56 in position. The use of this additional pin 64 extending between brackets 48 and 50 below pin 46 can also form a part of the interconnection illustrated in FIG. 2, serving as a means for preventing hook 44 of FIG. 2 jostling loose from pin 46, once the hook has been passed between the pins 46 and 64.

The invention has been described in some detail, and with particular reference to a front end loader. However, it will be apparent to those skilled in the art that the auxiliary blade of the present invention can equally well be attached to a backhoe or other similar equipment. Further, the auxiliary blade itself may take the form of some auxiliary equipment other than a snowplow, if desired. The details of the connection between the bucket and the auxiliary blade herein has been made with respect to only one end of the bucket, and it will be apparent that similar connections will be made at the other end of the bucket, and additional interconnecting arms could be utilized if desired. The invention is thus not to be considered limited to the specific details given herein by way of a description of a preferred embodiment, but only as set forth in the appended claims.

What is claimed is:

1. An apparatus for the unattended conversion of a front end loader quickly to and from a snowplow or the like, comprising:

an auxiliary blade of the free-standing type, capable of self-support in an operative orientation, means integral with the top edge of the bucket of the front end loader for grasping an upper portion of said auxiliary blade as such bucket is pivoted upwardly and forwardly, and means adjacent the bottom of said auxiliary blade for receiving the bottom edge of the bucket of the front end loader as such bucket is pivoted upwardly and forwardly, whereby attachment and release of said auxiliary blade to and from the bucket of the front end loader are achieved solely by respective opposite pivotal movements of such bucket.

2. An apparatus for the unattended conversion of a front end loader quickly to and from a snowplow or the like in accordance with claim 1, wherein said auxiliary blade is a snowplow having a V-shaped configuration in the horizontal plane.

3. An apparatus for the unattended conversion of a front end loader quickly to and from a snowplow or the like in accordance with claim 1, wherein said grasping means integral with the top edge of the bucket comprises an upwardly-open hook for engaging a cooperating pin connected to the upper portion of said auxiliary blade.

4. An apparatus for the unattended conversion of a front end loader quickly to and from a snowplow or the like in accordance with claim 3, wherein said grasping means comprises a plurality of said upwardly-open hooks spaced along the top edge of the bucket for engaging a corresponding plurality of cooperating pins connected to the upper portion of said auxiliary blade.

5. An apparatus for the unattended conversion of a front end loader quickly to and from a snowplow or the like in accordance with claim 1, wherein said grasping means integral with the top edge of the bucket comprises a pin for engaging a downwardly-open hook connected to the upper portion of said auxiliary blade.

6. An apparatus for the unattended conversion of a front end loader quickly to and from a snowplow or the like in accordance with claim 5, wherein said grasping means comprises a plurality of said pins spaced along the top edge of the bucket for engaging a corresponding plurality of cooperating downwardly-open hooks connected to the upper portion of said auxiliary blade.

7. An apparatus for the unattended conversion of a front end loader quickly to and from a snowplow or the like in accordance with claim 1, wherein said means for receiving the bottom edge of the bucket comprises one or more rearwardly-facing slots adjacent the bottom of said auxiliary blade adapted to receive and hold said edge of the bucket.

* * * * *